US008969748B2

(12) United States Patent
Endre et al.

(10) Patent No.: US 8,969,748 B2
(45) Date of Patent: Mar. 3, 2015

(54) SWITCH DEVICE AND A SWITCHGEAR PROVIDED THEREWITH

(75) Inventors: Thor Endre, Skien (NO); Tom-Rune Bjortuft, Porsgrunn (NO); Robert Espeseth, Skien (NO); Leif Lundin, Arboga (SE); Paal Kristian Skryten, Skien (NO)

(73) Assignee: ABB Research Ltd. (CH)

( * ) Notice: Subject to any disclaimer, the term of this patent is extended or adjusted under 35 U.S.C. 154(b) by 553 days.

(21) Appl. No.: 13/095,386

(22) Filed: Apr. 27, 2011

(65) Prior Publication Data

US 2011/0226528 A1 Sep. 22, 2011

Related U.S. Application Data

(63) Continuation of application No. PCT/EP2009/063664, filed on Oct. 19, 2009.

(30) Foreign Application Priority Data

Oct. 27, 2008 (EP) ..... 08167603

(51) Int. Cl.
*H01H 1/42* (2006.01)
*H01H 1/023* (2006.01)
*H01H 1/025* (2006.01)

(52) U.S. Cl.
CPC ..... *H01H 1/42* (2013.01); *H01H 1/023* (2013.01); *H01H 1/025* (2013.01)
USPC ..... 200/254; 200/48 KB

(58) Field of Classification Search
USPC ..... 200/254, 255, 48 A, 48 KB, 554, 273
See application file for complete search history.

(56) References Cited

U.S. PATENT DOCUMENTS

| | | | | |
|---|---|---|---|---|
| 3,478,185 | A | 11/1969 | Perkins et al. | |
| 3,641,300 | A * | 2/1972 | Nitz | 200/254 |
| 3,739,115 | A * | 6/1973 | McClain et al. | 200/48 R |
| 3,824,355 | A | 7/1974 | Norman et al. | |
| 4,025,747 | A * | 5/1977 | Bharteey et al. | 200/254 |
| 4,467,161 | A | 8/1984 | Fox et al. | |
| 5,025,121 | A * | 6/1991 | Allen et al. | 200/275 |
| 5,241,144 | A | 8/1993 | Meagher et al. | |

FOREIGN PATENT DOCUMENTS

| | | |
|---|---|---|
| CN | 201138633 Y | 10/2008 |
| EP | 0310211 A2 | 4/1989 |

OTHER PUBLICATIONS

European Search Report; Application No. EP 08 16 7603; Mar. 23, 2009; 6 pages.

(Continued)

*Primary Examiner* — Renee Luebke
*Assistant Examiner* — Lheiren Mae A Caroc
(74) *Attorney, Agent, or Firm* — St. Onge Steward Johnston & Reens LLC

(57) ABSTRACT

A switch device including a bus bar, and a switch knife, wherein the knife is arranged so as to pivot around an axis perpendicular to a longitudinal axis of the bus bar. The bus bar presents a projection which is an integrated part of the bus bar, and the knife is pivotable to a first position, in which it directly contacts said projection, and to a second position in which it is removed from contact with said projection.

18 Claims, 4 Drawing Sheets

(56) References Cited

OTHER PUBLICATIONS

International Search Report and Written Opinion of the International Searching Authority; PCT/EP2009/063664; Jan. 7, 2010; 12 pages.

First Office Action from the Patent Office of the People's Republic of China Application No. 200980142708.8 Applicant: ABB Research LTD Issued: Mar. 28, 2013 7 pages.

* cited by examiner

SWITCH DEVICE AND A SWITCHGEAR PROVIDED THEREWITH

CROSS-REFERENCE TO RELATED APPLICATIONS

The present application is a continuation of pending International patent application PCT/EP2009/063664 filed on Oct. 19, 2009 which designates the United States and claims priority from European patent application 08167603.3 filed on Oct. 27, 2008, the content of which is incorporated herein by reference.

FIELD OF THE INVENTION

The present invention relates to a switch device comprising a bus bar and a switch knife, wherein the knife is arranged so as to pivot around an axis perpendicular to a longitudinal axis of the bus bar.

The invention also relates to medium or high voltage switchgear provided with a switch device in accordance with the invention.

A bus bar is referred to as a voltage-carrying electric conductor. The switch device may be provided for the purpose of connecting or disconnecting the bus bar from/to any further electric power distribution components, such as a cable. A plurality of switches may be provided in order to connect a plurality of elements, such as electric cables, to a predetermined bus bar.

Medium or high voltage is referred to as voltages of 1 kV or more.

BACKGROUND OF THE INVENTION

Contemporary selector switches of medium voltage switchgear are used for disconnecting a part of an interrupter from a bus bar upon activation of the interrupter. The selector switch comprises a connector element called a knife that, after interruption by means of an in series connected interrupter or breaker has taken place, moves from a first position, in which it is in electric contact with the bus bar, to a second position, in which it is electrically disconnected from the bus bar. In the second position, the switch knife may be electrically connected to ground.

According to prior art the selector switch may be provided in a switchgear housing filled with any suitable electrically insulating gas or gas mixture, such as SF6. The bus bar may have a rectangular cross-section and be made of copper, possibly covered by a layer of silver. A connector element formed by a hooked copper plate is attached to the bus bar at a location corresponding to the location of the switch knife. The connector element comprises a first shank attached to the bus bar, and a second shank extending perpendicularly to the first shank and forming an element to be contacted by the switch knife. The first shank of the connector element may be bolted to the bus bar. The knife normally comprises two parallel shanks or arms that, in the first position in which the knife contacts the second shank of the connector element, overlap said second shank on opposite sides thereof. Preferably, those surfaces of the knife that are assumed to contact the second shank of the connector element are provided with projections, preferably bulges, in order to guarantee a good and reliable contact.

It is an object of the present invention to present a switch device which is of a design that promotes a cost efficient production thereof. A robust design with as few components as possible is also desired.

SUMMARY OF THE INVENTION

The object of the invention is achieved by providing a switch device comprising a bus bar, and a switch knife, where the knife is arranged so as to pivot around an axis perpendicular to a longitudinal axis of the bus bar, wherein the bus bar presents a projection which is an integrated part of the bus bar, and wherein the knife is pivotable to a first position, in which it directly contacts said projection, and to a second position in which it is removed from contact with said projection. Thereby, the switch knife operates directly against the bus bar, without any intermediate connector element. The projection of the bus bar will form a connector element that, in contrast to connector elements of prior art, is an integrated part of the bus bar. Thus, the switch device of the present invention promotes a cost efficient production thereof, and has a robust design with few components in relation to prior art. Advantageously, the projection extends in the longitudinal direction of the bus bar, advantageously along the whole length of the bus bar. Advantageously, the projection forms a portion that protrudes from the rest of the bus bar, in a direction towards the switch knife, and has a smaller thickness, or width, than the rest of the bus bar. The bus bar may have a T-shape as seen in a cross-section thereof. Advantageously, the cross section of said projection remains the same along the longitudinal direction of the bus bar.

According to an advantageous embodiment of the switch device according to the present invention, the projection is integral with the bus bar. This embodiment further promotes a cost efficient production of a switch device, and provides a robust switch device design with few components in relation to prior art.

According to a further advantageous embodiment of the switch device according to the present invention, on at least one side of said projection, there is provided a lateral elevation extending in the longitudinal direction of the bus bar, said knife being arranged to contact said elevation when pivoted into its first position. The elevation is lateral in relation to the longitudinal direction of the bus bar, or alternatively, the elevation has an extension in a lateral, or transverse, direction in relation to the longitudinal direction of the bus bar. By means of said elevation, separated projection or bulges on the knife may be dispensed with, and a good contact between knife and bus bar may still be achieved. Advantageously, the elevation extends in the longitudinal direction of the projection. Advantageously, the elevation forms a lateral rib or bulge on said projection. The elevation is provided on a side of the projection of the bus bar on which at least a part of the knife is arranged to contact the bus bar. Accordingly, said part of the knife will should be arranged so as to be applied with a lateral force against said elevation or bulge when moved into its first position, i.e. the position in which it is in direct contact with the bus bar. Advantageously, the knife is provided with a spring element that provides a spring force that, in said first position, forces the knife into contact with the lateral elevation of the bus bar.

According to another advantageous embodiment of the switch device according to the present invention, on opposite sides of said projection, there is provided a lateral elevation extending in the longitudinal direction of the bus bar, said knife being arranged to contact each such elevation when pivoted into its first position. Each elevation is lateral in relation to the longitudinal direction of the bus bar, or alternatively, each elevation has an extension in a lateral, or transverse, direction in relation to the longitudinal direction of the bus bar. Advantageously, both elevations are arranged in correspondence with the above description for the at least one elevation. Advantageously, the knife comprises two parallel shanks separated by a gap. The shanks are flexibly arranged, thereby permitting a delimited altering of the gap between them. When the knife is moved into its first position, the shanks thereof will contact opposite sides of the projection of the bus bar. Advantageously, a spring element is provided in said gap in engagement with the respective shank, whereby, in said first position, the spring element urges the shanks towards each other, thereby promoting a clamping of the bus bar between the shanks of the switch knife.

According to yet another advantageous embodiment of the switch device according to the present invention, in a region in which the projection is in contact with the knife when the latter is in its first position, the projection presents an outer surface comprising a material of less prone to oxidation than the bulk part of the switch knife. Alternatively, said outer surface has a higher mechanical strength, in particular a higher wear resistivity than the material of the bulk part of the bus bar. Advantageously, said outer surface has Sn, Ni, Ag or Au as its main constituent. By providing the bus bar with such an outer surface in the region in which it contacts the knife, a bulk part of the bus bar may comprise a material that is optimized for its function as a conductor and may promote a cost efficient production of the bus bar, while said surface is optimized to the specific requirements of such a surface, such as being more subjected to corrosion than the rest of the bus bar.

According to a further advantageous embodiment of the switch device according to the present invention, in a region adjacent to the region in which said outer surface is provided, the projection is covered by a material to which the main constituent of said outer surface is non-adhesive. In other words the bus bar has been provided with a cover or mask onto which a layer comprising any of Sn, Ni, Ag or Au is unlikely to adhere, wherein said mask does not cover those areas in which a layer of Sn, Ni, Ag or Au is to be provided. Thereby, excessive use of a costly layer material such as Ag or Au is prevented. Advantageously, the cover layer or mask comprises an electrically insulating material, in order to further prevent corrosion of the bus bar. Advantageously it covers all the surface of the bus bar that is not covered by said outer surface comprising Ni, Sn, Ag or Au.

According to an advantageous embodiment of the switch device according to the present invention, a bulk part of the bus bar comprises aluminium as its main constituent. Aluminium is an advantageous material from both an environmental point of view and from a purely cost-related point of view. It is easily extruded, which is of importance in this context since, according to an advantageous embodiment of the switch device according to the present invention, the bus bar is formed by an extruded profile. Advantageously, the extruded profile comprises the above-mentioned projection as well as lateral elevations provided on the latter. Depending on the environment to which it is subjected, a bus bar made of aluminium may or may not be provided with the above-mentioned outer surface of different material.

As already mentioned previously, according to an advantageous embodiment of the switch device according to the present invention, said knife comprises two shanks separated by a gap, said shanks being arranged so as to contact opposite sides of said projection of the bus bar when the knife is in its first position.

It is advantageous that a bulk part of the knife comprises Cu as a main constituent. Cu is advantageous with regard to its low electric resistivity. As an alternative to copper, aluminium may be used as a main constituent of the bulk part of the switch knife.

According to another advantageous embodiment of the switch device according to the present invention, in a region in which the knife is in contact with the projection when in its first position, the knife presents an outer surface comprising Sn, Ni, Ag or Au as its main constituent. Thereby, an improved corrosion resistance of the knife is provided in those contact areas in which the corrosion conditions are harsher. By providing the switch device with features that provides improved corrosion resistance, the switch device will be more apt to be used in an oxygen-containing atmosphere such as air.

According to a further advantageous embodiment of the switch device according to the present invention, the switch device comprises a stop means for preventing pivoting of the knife from the second position beyond the first position. Any such pivoting of the knife beyond the first position would result in a situation in which the risk of having electric discharges between the knife and the bus bar would be obvious. Since such discharges might be detrimental for the functionality of a switchgear or the like in which the switch may be provided, this feature confers an advantage to the device. The stop means may be provided on the bus bar or on the switch knife, or on a shaft by means of which the switch knife is rotated between its different positions. For example, such a means may include a stop heel or the like, preventing excessive rotation of such a shaft from the second position beyond the first position.

According to another advantageous embodiment of the switch device according to the present invention, the device comprises a securing means for securing the knife in its first position. Thereby, accidental disconnection of the knife from the bus bar is further avoided.

According to yet another advantageous embodiment of the switch device according to the present invention, said securing means comprises a recess provided in said projection of the bus bar. The knife may then present an engagement element for engagement with said recess. Advantageously, said engagement element comprises a pin or bolt that engages each of two opposite shanks of the switch knife and extends in a lateral direction through the gap between said shanks. The device may comprise a rack and pinion gear provided so as to urge the engagement means of the switch knife, i.e. said pin or bolt, into engagement with the engagement means of the bus bar, i.e. said recess, in said first position and lock the switch knife in said position. Accordingly, the knife is displaceable in relation to and perpendicularly to its pivotation axis through a translational motion in order to permit the securing of the knife in relation to the bus bar. Solutions with a spring acting either on the pin, if the latter is displaceably arranged in relation to the rest of the knife, or on the knife, if the latter is displaceably arranged in relation to its pivotation axis, are also conceived.

The device may comprise a spring provided so as to urge said pin or bolt into engagement with said recess in said first position and lock the latter in said position. Accordingly, the pin may be displaceable in relation to the knife, or the knife may be displaceable in relation and perpendicularly to its pivotation axis through a translational motion in order to permit the securing of the knife in relation to the bus bar. Said spring may act either on the pin, if the latter is displaceably arranged in relation to the rest of the knife, or on the knife, if the latter is displaceably arranged in relation to its pivotation axis.

The invention also relates to a medium or high voltage switchgear, which is characterized in that it comprises a switch device according to the invention. Typically such a switchgear comprises at least one, but advantageously a plurality of compartments, each carrying three bushings (one for each phase in a three-phase system) to be connected to three exterior power cables outside the switchgear, a breaker for each phase inside said compartment, an electric conductor that extends from the bushing of each phase to a first end of a breaker, and a switch knife (one for each phase, used for connecting or disconnecting a second end of said breaker to/from an electric connector formed by a so-called bus-bar (one for each phase) that extends through the compartments.

Accordingly, the switchgear advantageously defines an inner space in which said switch device is arranged. It might be advantageous said inner space being filled with an electrically insulating gas mixture. The gas mixture may contain oxygen, whereby the provision of oxidation resistant or corrosion resistant surfaces on the switch knife and the bus bar will be advantageous.

Further features and advantages of the present invention will be presented in the following detailed description and in the appended claims.

BRIEF DESCRIPTION OF THE DRAWINGS

Embodiments of the invention will now be described more in detail with reference to the annexed drawing, on which.

DETAILED DESCRIPTION OF THE INVENTION

Figure 1:
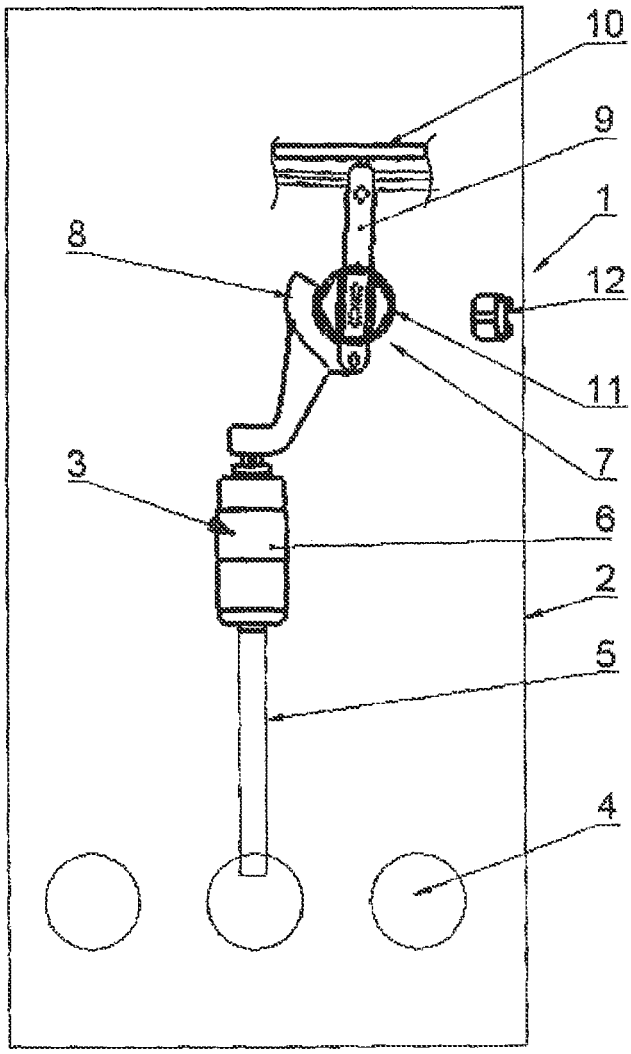
FIG. 1 is a side view of a part of the interior of a switchgear provided with a switch device according to the invention.

FIG. 1 shows an electric power distribution switchgear 1 according to the invention. The switchgear 1 comprises an encapsulation 2, advantageously made of or at least comprising a metal, inside which a number of switch devices 3, only one of which is shown in the figure, are housed. The switch devices not shown in the figure are arranged in parallel with the one shown and are thus either hidden behind the one shown or located in planes in front of the latter and not shown in the figure. A wall of the encapsulation 2 is penetrated by a number of bushings 4, one for each phase of a plural phase system. From each bushing 4 a respective conductor 5, only one of which is shown in the figure, extends to a respective switch device 3. On the outside of the encapsulation 2 the bushings 4 are connected to cables, not shown, that either connect the switchgear 1 to a load or to a medium or high voltage power distribution line.

Each switch device 3 according to the invention comprises a breaker 6 connected in one end to the conductor 5 that extends from a dedicated bushing 4, and in another end to a switch 7. The breaker 6 is a vacuum interrupter that, though not shown in the drawing but as known per se, has a fixed part and a moveable part, wherein the fixed part is connected the conductor 5 and the moveable part is connected to the switch. The switch 7 is a so called safety switch or selector switch which is not adapted to break a medium or high voltage circuit itself but only to disconnect the breaker from a medium or high voltage line after breaking has been performed by means of the breaker. The switch 7 comprises a contact element 8 permanently connected to the breaker 6, and a switch knife 9. The switch knife is movable between positions in which it connects the breaker 6 with a further conductor 10 formed by a so called bus bar that extends through the switchgear 1, with ground or an open position in which the breaker is neither connected to the bus bar nor to the ground. The reasons to why these positions are used during operation of the switchgear are well known to persons skilled in the art and will, therefore, not be further described here.

It should be understood that a switchgear may comprise a plurality of switchgears, or units, such as the one described above. For each electric phase there is a common bus bar, like the conductor 10 defined above, that extends from unit to unit. The encapsulation may or may not be common for the plurality of switchgear/units. The encapsulation may be filled with an electrically insulating gas or gas mixture, which, advantageously, is pressurised. Air-filled encapsulations are also conceived.

The switch device 3 comprises a shaft 11 onto which the switch knife 9 is attached. The shaft 11 is common for the parallel three switches 7 of the three-phase switch-gear described so far. The shaft 11 extends through a wall of the encapsulation 2 and is manoeuvrable from outside the encapsulation 2. The bus bar 10 extends horizontally in an upper part of the compartment defined by the encapsulation 2, and there is provided a grounded element 12 on an inner wall of the encapsulation 2, below the level of the bus bar 10.

Figure 2:
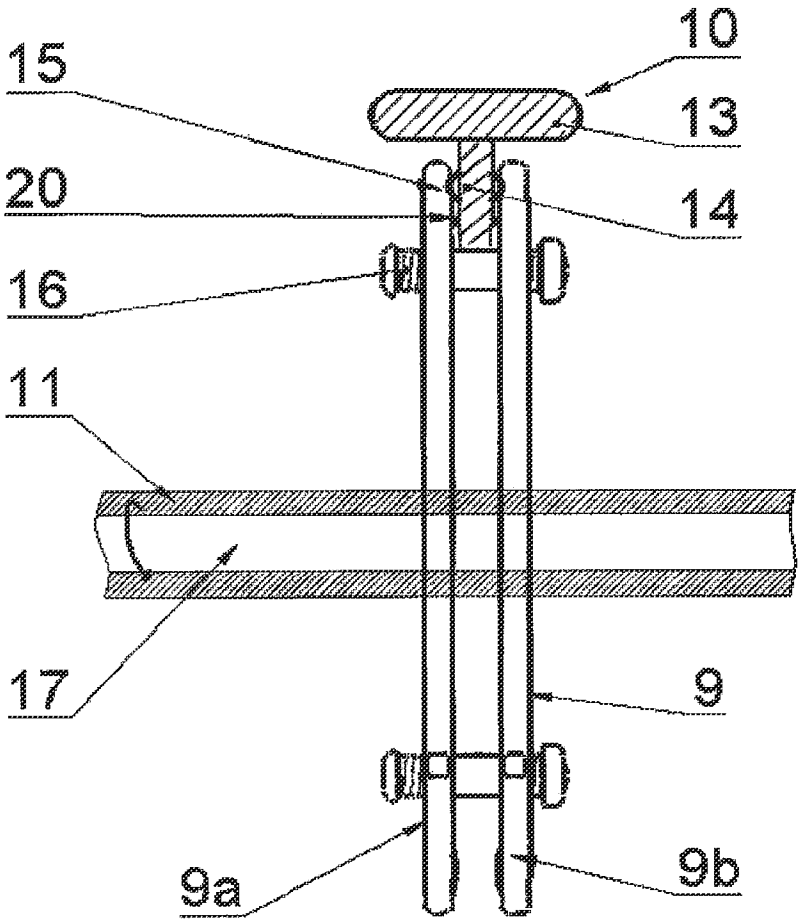
FIG. 2 is side view of the knife, showing a cross-section of the bus bar with which the switch knife is in contact.
Figure 3:
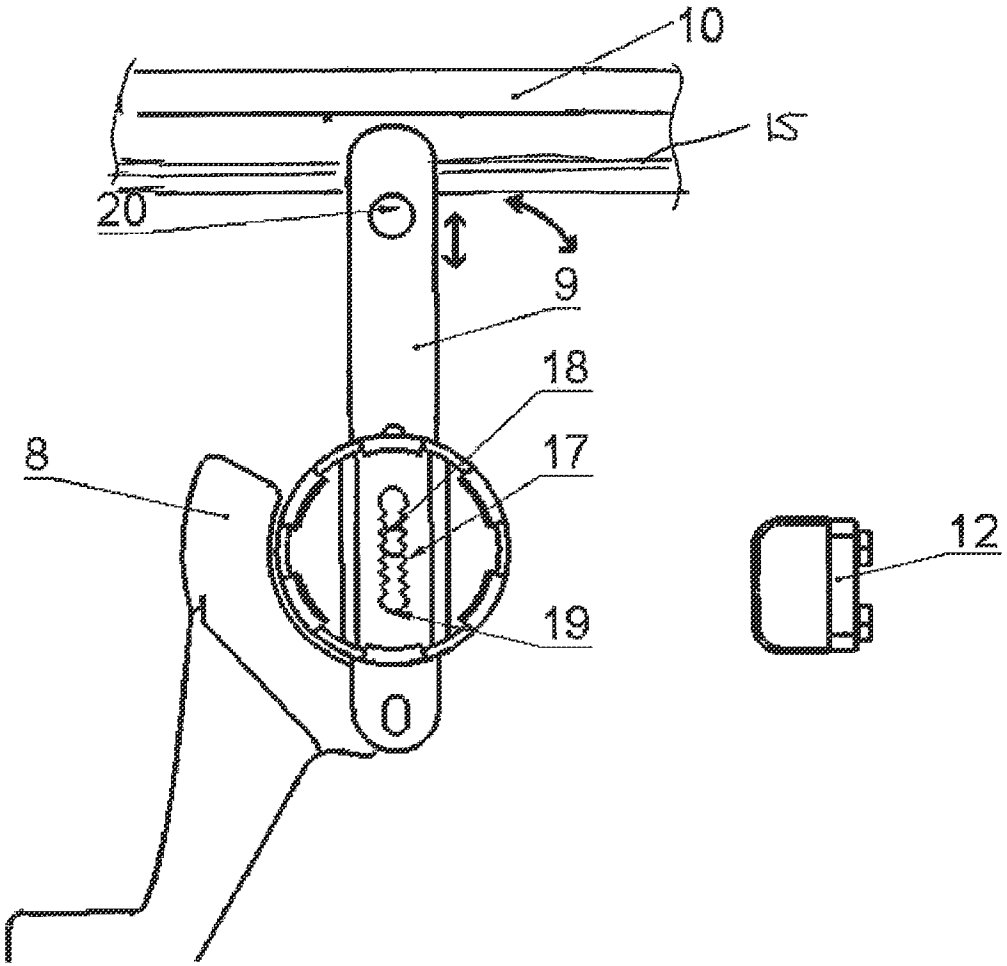
FIG. 3 is a side view corresponding to FIG. 1, showing the switch more in a larger scale than in FIG. 1, with the switch knife in a first position.

The bus bar 10 is formed by an extruded metal profile, advantageously based on aluminium. FIG. 2 shows the cross-section of said profile. Said profile comprises a base part 13, i.e. the upper part as shown in FIG. 2, from which a projection 14 of smaller width than the base part extends towards the region of the switch knife 9, i.e. downwards in the embodiment presented here. In this embodiment, the projection 14 is integral with the bus bar 10. On each lateral sides of said projection 14 there is provided a lateral bulge or elevation 15 that also forms part of profile of the bus bar 10 as extruded. In other words, each bulge 15 extends in the longitudinal direction of the bus bar 10 as a permanent part thereof. FIG. 2 shows the switch knife 9 in a first position in which it physically and electrically connected to the bus bar 10. As can be seen, the knife 9 comprises two opposite shanks 9*a*, 9*b* held by the shaft 11. An end of each shank of the knife overlaps the projection 14 in the connected position and a spring 16 provided between the shanks provides for pretension of the knife shanks against the bulges 15 of the bus bar 10. As can be seen in FIG. 3, there is also provided a second shaft 17 coaxially with and inside the first shaft 11. The function of the second shaft 17 will be explained later.

FIG. 3 corresponds to FIG. 2, but shows the switch from a perpendicular angle. As can be seen in FIG. 3, the second shaft 17 carries teeth 18, suitably on a geared wheel attached to the shaft 17. The knife 9 comprises an elongated slot that extends in the longitudinal direction thereof. Along a side of the slot there is provided a rack 19, such that, upon rotation of the shaft 17 a longitudinal displacement of the knife 9 in relation to the first shaft 11 and to its privation axis is achieved. It should be understood that the knife 9 is slideably seated in or attached to the shaft 11 in order to allow such displacement. Thus, the switch comprises a rack and pinion gear by means of which longitudinal displacement of the switch knife 9 is permitted. The second shaft 17, likewise the first shaft 11, should extend such that it is manoeuvrable from outside the encapsulation 2.

Figure 4:
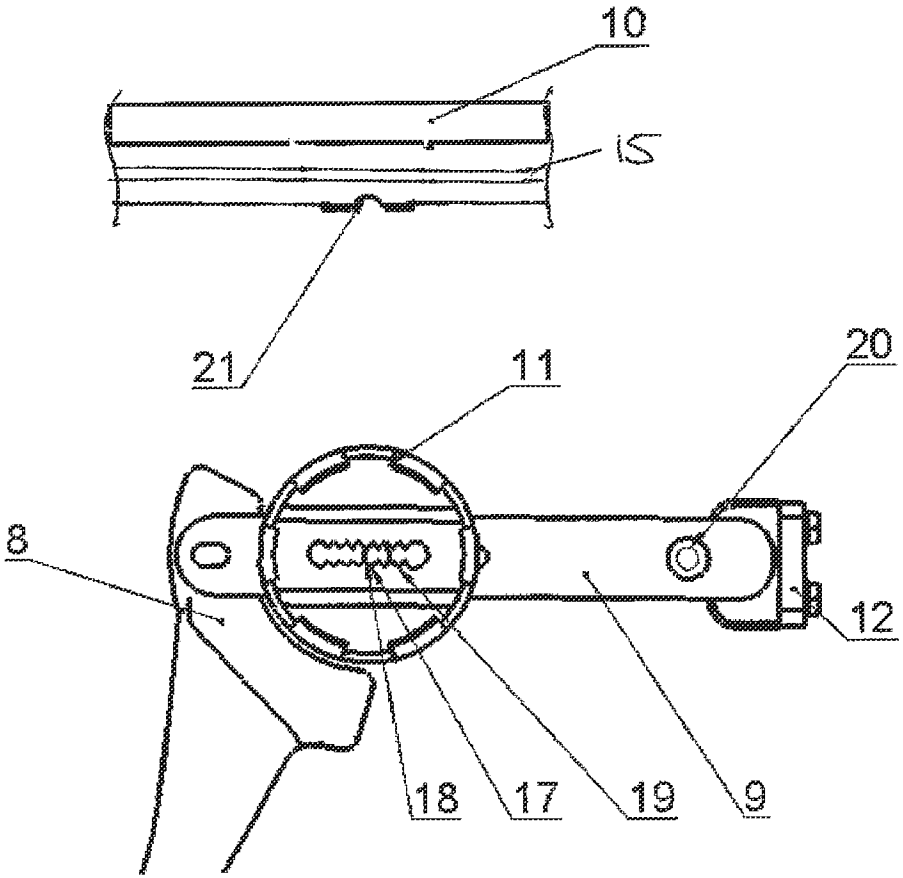
FIG. 4 is a side view corresponding to FIG. 3, but showing the switch knife in a second position.

As can be seen in FIGS. 2-4, there is provided an engagement means formed by a pin or tap 20 that extends between the shanks 9*a*, 9*b* of the switch knife in the region of the end in which the knife 9 contacts the bus bar 10. As can be seen in FIG. 4, which shows the switch knife 9 in a second position in which it is disconnected from the bus bar 10, there is a corresponding engagement means formed by a recess 21 provided in the bus bar 10. Upon pivotation of the switch knife 9 from a second position such as shown in FIG. 4 to a first position, as shown in FIG. 1, securing of the switch knife in the first position is provided for by means of said engagement means. When the first position is reached, a longitudinal displacement of the switch knife 9 towards the bus bar 10 is performed by means of the rack and pinion gear previously described, such that the pin or tap 20 engages the recess 21. In order to permit pivotation from the first position a corresponding opposite displacement must be performed.

Though not shown in the figures, it should be mentioned that, in a region in which the bulges 15 of the projection 14 is in contact with the knife 9 when the latter is in its first position, the projection 14 presents an outer surface comprising Sn, Ni, Ag or Au as its main constituent. The bulk part of the bus bar advantageously comprises an Aluminum alloy.

Advantageously, in a region adjacent to the region in which said outer surface is provided, the projection 14 is covered by a material to which the main constituent of said outer surface is not adhesive. During production of the bus bar 10 the latter has been provided with a cover or mask onto which a layer comprising any of Sn, Ni, Ag or Au is unlikely to adhere, wherein said mask does not cover those areas in which a layer of Sn, Ni, Ag or Au is to be provided. Thereby, excessive use of a layer material such as Ag or Au is prevented. Advantageously, the cover layer or mask comprises an electrically insulating material, in order to further prevent corrosion of the bus bar. Advantageously it covers all the surface of the bus bar that is not covered by said outer surface comprising Ni, Sn, Ag or Au.

It is advantageous that a bulk part of the knife 9 comprises Cu as a main constituent. Cu is advantageous with regard to its low electric resistivity. In a region in which the knife 9 is in contact with the projection 14 when in its first position, the knife 9 presents an outer surface comprising Sn, Ni, Ag or Au as its main constituent. Thereby, an improved corrosion resistance of the knife 9 is provided in those contact areas in which the corrosion conditions may be harsher.

It should be understood that the above description of embodiments is only made by way of example and that a plurality of alternative solutions will be obvious for a person skilled in the art without thereby going beyond the scope of protection defined by the annexed claims.

For example the bus bar 10 may comprise more than one projection provided to contact the switch knife in the connected first position. Likewise, the switch knife 9 may be comprised by only one piece instead of the double shanks 9*a*, 9*b* presented here.

What is claimed is:

1. A switch device comprising:

a bus bar having a base and a projection that is an integrated part of the bus bar and extending away from the base; and a switch knife arranged so as to pivot around an axis perpendicular to a longitudinal axis of the bus bar, wherein the knife is pivotable to a first position, in which it directly contacts said projection, and to a second position in which it is removed from contact with said projection, wherein, on opposite sides of said projection, there is provided a lateral elevation extending in the longitudinal direction of the bus bar, said knife being arranged to contact said elevation when pivoted into its first position.

2. The switch device of claim 1, wherein the projection is integral with the bus bar.

3. The switch device of claim 1, wherein, in a region in which the projection is in contact with the knife when the latter is in its first position, the projection presents an outer surface comprising Sn, Ni, Ag or Au as its main constituent.

4. The switch device of claim 3, wherein, in a region adjacent the region in which said outer surface is provided, the projection is covered by a material to which the main constituent of said outer surface is non-adhesive.

5. The switch device of claim 1, wherein a bulk part of the bus bar comprises aluminum as its main constituent.

6. The switch device of claim 5, wherein the bus bar is formed by an extruded profile.

7. The switch device of claim 1, wherein said knife comprises two shanks separated by a gap, said shanks being arranged so as to contact opposite sides of said projection of the bus bar when the knife is in its first position.

8. The switch device of claim 1, wherein a bulk part of the knife comprises Cu as a main constituent.

9. The switch device of claim 1, wherein, in a region in which the knife is in contact with the projection when in its first position, the knife presents an outer surface comprising Sn, Ni, Ag or Au as its main constituent.

10. The switch device of claim 1, further comprising a stop means for preventing pivoting of the knife from the second position beyond the first position.

11. The switch device of claim 1, further comprising a securing means for securing the knife in its first position.

12. The switch device of claim 11, wherein said securing means comprises a recess provided in said projection of the bus bar.

13. A medium or high voltage switchgear, comprising a switch device according to claim 1.

14. The switchgear of claim 13, wherein it defines an inner space in which said switch device is arranged, said inner space being filled with an oxygen-containing gas mixture.

15. The switch device of claim 1, wherein the bus bar is formed by an extruded profile.

16. The switch device of claim 1, wherein the cross section of the projection remains the same along the longitudinal direction of the bus bar.

17. A switch device comprising:

a bus bar having a base and a projection that is an integrated part of the bus bar and extending away from the base; and a switch knife arranged so as to pivot around an axis perpendicular to a longitudinal axis of the bus bar, wherein the knife is pivotable to a first position, in which it directly contacts said projection, and to a second position in which it is removed from contact with said projection, wherein a cross-section of the bus bar comprises a base part from which the projection extends towards the region of the switch knife, the projection being of smaller width than the base part, wherein the bus bar has a T-shape as seen in a cross-section thereof.

18. A switch device comprising:

a bus bar having a base and a projection that is an integrated part of the bus bar and extending away from the base; and a switch knife arranged so as to pivot around an axis perpendicular to a longitudinal axis of the bus bar, wherein the knife is pivotable to a first position, in which it directly contacts said projection, and to a second position in which it is removed from contact with said projection, wherein a cross-section of the bus bar comprises a base part from which the projection extends towards the region of the switch knife, the cross section of said projection remaining the same along the longitudinal direction of the bus bar, wherein the bus bar has a T-shape as seen in a cross-section thereof.

* * * * *